US005804781A

United States Patent [19]

Okabe

[11] Patent Number: 5,804,781

[45] Date of Patent: Sep. 8, 1998

[54] FEED-BACK CONTROL PLATE FOR JOYSTICK

[75] Inventor: Kenji Okabe, Tokyo, Japan

[73] Assignee: Perfect 360 Controls, Inc., Midvale, Utah

[21] Appl. No.: 745,898

[22] Filed: Nov. 7, 1996

[51] Int. Cl.[6] ..... H01H 25/04

[52] U.S. Cl. ..... 200/6 A

[58] Field of Search ..... 200/4, 5 R, 6 R, 200/6 A, 17 R, 18

[56] References Cited

U.S. PATENT DOCUMENTS

| | | | |
|---|---|---|---|
| 3,666,900 | 5/1972 | Rothweiler et al. | 200/6 A |
| 3,827,313 | 8/1974 | Kiessling | 74/471 XY |
| 4,315,113 | 2/1982 | Fisher et al. | 200/5 R |
| 4,538,035 | 8/1985 | Pool | 200/6 A |
| 4,575,591 | 3/1986 | Lugaresi | 200/6 A |
| 5,177,102 | 1/1993 | Mitchell | 250/229 |
| 5,473,325 | 12/1995 | McAlindon | 341/20 |

FOREIGN PATENT DOCUMENTS

| | | | |
|---|---|---|---|
| PCT/US93/04587 | 11/1994 | WIPO | G01D 5/34 |

*Primary Examiner*—Michael L. Gellner
*Assistant Examiner*—Michael A. Friedhofer
*Attorney, Agent, or Firm*—James L. Sonntag

[57] ABSTRACT

An eight-way joystick control system is disclosed. The joystick comprises a control shaft having a handle end adapted for grasping and deflection of the control shaft by a user, and pivot defining a fixed point about which the control shaft is deflected at the handle end by the user. The control shaft has a central neutral position and eight control sector positions spaced radially around the neutral position. An indicator is included that produces a distinctive electrical signal when the control shaft is in each of the control sector positions. A control structure defines a deflection limit of the control shaft in an octagon shaped deflection pattern with eight corners. Each corner corresponds to one of the eight control sector positions such that when the control shaft is deflected into any one of the eight corners the control shaft is positioned in the corresponding control sector position. The control structure provides for a smooth unimpeded deflection limit between the corners, and provides a stop for tactile feedback to the user indicating that the control shaft is in the control sector position corresponding to a corner.

18 Claims, 11 Drawing Sheets

PRIOR-ART

PRIOR-ART

FEED-BACK CONTROL PLATE FOR JOYSTICK

FIELD OF THE INVENTION

This invention relates to joystick control devices, and the like.

BACKGROUND OF THE INVENTION

Typically a joystick-type control device comprises a pivotable control shaft that actuates a switch when moved in a particular direction. A joystick that actuates every 90 degrees around a 360 degree circle (forward, backward, left and right) is called a four-way joystick. A joystick that actuates every 45 degrees around a 360 degree circle is called an eight-way joystick. In conventional eight-way joystick construction, electrical or mechanical (or electromechanical) switches are arranged around the joystick shaft in such a manner that when the joystick is deflected or moved around the 360 degree circle, eight different areas of position can be selected and controlled (every 45 degrees). For purposes of this application, these eight areas are called sectors.

The utility of the joystick is heavily dependent upon the ability of the user to position the joystick while determining exactly in which sector the joystick is positioned, without having to visually observe the joystick. For instance, a video game with an 8-way joystick could allow the player to move a character 8 different directions around the screen. The player deflects the joystick in the direction he want the character to move. However, if the player must rely mostly visual observation of the joystick and/or the action on the screen to determine the sector position of the joystick, he may not be able to react quickly enough in a difficult play. For example, if the player must quickly move from the forward (12 o'clock) direction to the 7:30 o'clock direction, he may be delayed in the movement while he tries to seek out the correct sector for the joystick.

Advanced video games have functions that require complex moves with an 8way joystick. For example, a specific function may be the requirement to move the joystick from a neutral center position, forward to zero degrees (12 o'clock), back to neutral, then to 135 degrees (4:30 o'clock), back to neutral, then to 180 degrees (6 o'clock), all quickly and with precision. Depending upon the skill of the player, this combination of joystick moves could be very difficult unless the joystick had a means to transmit to the player the sector position of the joystick.

Every joystick is designed with specific limits as to the amount of deflection from neutral to any position around the circle in which it may be deflected. For a specific use, this limit could be a long throw or a very short throw, depending upon the construction of the joystick. There are many ways of governing the limit of the deflection of a joystick, such as a simple spring that becomes fully depressed or a solid component of the joystick with which the joystick shaft makes contact. The solid component could be in the form of a control plate with a circular aperture, which would allow the user to smoothly move the joystick from one sector to the other at the limit of deflection. For a 4-way joystick, which provides control in four-sectors (forward, backward, left, and right) a user can naturally, and by intuition, feel into which sector the joystick is being moved, forward, backward, up or down. Thus, a control plate with a smooth circular aperture has been found to adequate for a 4-way joystick.

For advanced games, eight-way joysticks have been also been provided with control plates that allow smooth movements between sectors at the limit of deflection, so that there is no feedback that would indicate to the user in which sector the joystick is positioned. However, with 8 sectors, natural intuition is insufficient to accurately distinguish movement to narrower sectors, four of which are at unnatural inclined angles. For example a quick diagonal forward/left movement from neutral, if not exactly precise may move the joystick into the forward or left sector, rather than the intended diagonal 45 degree, forward/left sector. Accordingly, it would be easy for the user to ere in his belief as to the actual position of the joystick. Such an error could be critical in the loss of a game.

It would be desirable to have an 8-way joystick that would accurately transmit the sector position of the joystick at the limits of deflection. Such a joystick would preferably be simple, inexpensive, and adaptable to most joystick constructions, and preferably involves a retrofit device that could be added to a joystick or replace an existing component.

OBJECTS OF THE INVENTION

It is, therefore, an object of the invention to provide a joystick that accurately transmits feedback to the user the exact sector when the joystick is moved at the limit of its deflection.

It is also an object of the invention to provide a device that can be retrofitted into an existing joystick construction.

It is also an object of the invention to provide a device that is simple in construction and can be mass produced at a relatively low cost.

Further objects of the invention will become evident in the description below.

SUMMARY OF THE INVENTION

The invention involves a mechanical device that transmits to the user the sector position of an 8-way joystick moved to the limit of deflection of the joystick. Specifically, the present invention functions to transmit a tactile feedback to the user the 45 degree angle or sector position of the joystick at the limit of its deflection. In a preferred embodiment, the invention comprises a control plate with an octagon shaped aperture. The octagon aperture is aligned to precisely indicate that the joystick is firmly in a sector. When the joystick shaft is in a corner of the octagon aperture, the user can feel the corner, thus there is a tactile indication of the center of the sector. Rotating the joystick around its limits of deflection, will cause the joystick to enter each of the eight corners of the aperture, thus tactily indicating to the user that the joystick is in the center of the corresponding sector.

A joystick of the invention comprises a control shaft handle having a control end adapted for manipulation by a user. A pivot is provided which defines a fixed point about which the control shaft is deflected at the control end by the user. The deflection limit of the control shaft is defined by a control structure in a deflection pattern in the shape of an octagon. Being an 8-way joystick, the control shaft has a neutral position and can be deflected into eight control sector positions disposed radially around the neutral position with centers on 45 degree lines. An indicator, such as one comprising electromechanical switches produces a distinctive electrical signal when the control shaft is in each of the control sector positions. The control structure is disposed such that when the control shaft is deflected to its limit into a corner of the octagon deflection pattern it is positioned in a control sector. Each of the eight corners of the octagon deflection pattern define a control shaft position that is within, preferably in the center of, each of the respective eight control sectors.

DETAILED DESCRIPTION OF THE INVENTION

The invention is contemplated for any joystick construction incorporating a control shaft that is pivoted on a pivot point to actuate movement detectors or indicators. These included, but are not limited to the electromechanical, and optical-electrical joystick position indicator systems disclosed in U.S. Pat. No. 5,117,102, to Mitchell (which incorporated herein by reference), and Patent Cooperation Treaty Application PCT/US93/04587.

The control structure that defines the octagon deflection limit pattern may be any suitable structure or combination of structures on the joystick. The preferred, and simplest structure is a plate with an octagon shaped aperture through which the control shaft extends. The plate is disposed a distance from the pivot point, either above or below, such that the control shaft bears against the inner edges of the aperture to limit the deflection of the control shaft. Other structures are also contemplated, such as two plates with apertures below and above the pivot point. The plates may have matching octagon apertures, or may have square apertures with one aperture aligned 45 degrees relative to the other.

The joystick is an eight-way joystick with eight control sectors radially surrounding a neutral position, usually with centers spaced as 45 degrees. The corners of the octagon deflection limit pattern are disposed at or near the center lines of the control sectors so that when the user moves the control stick into a corner it is firmly within the sector. The "lock" into the corner provides tactile feedback to the user that the control shaft is indeed within the desired control sector and the user does not have to rely on other clues to determine the sector location of the control shaft.

Figure 1:
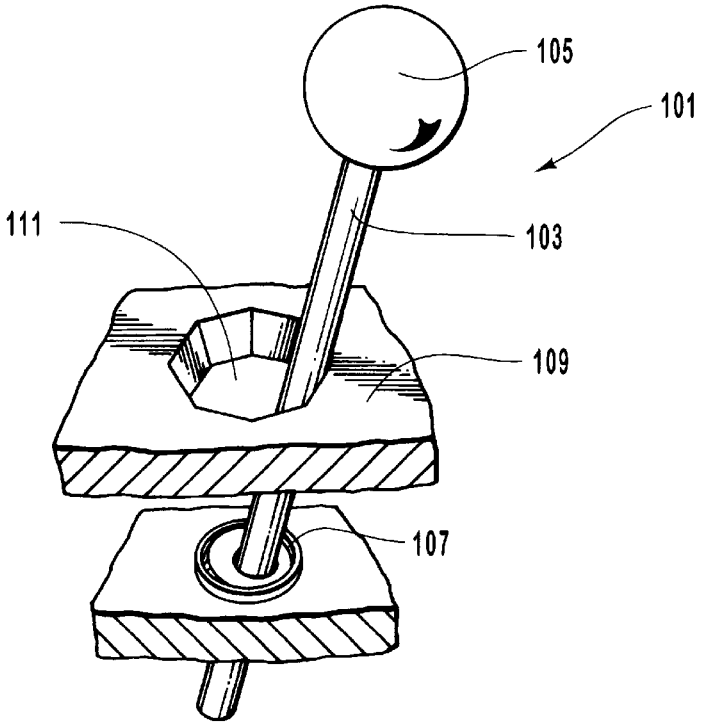
FIGS. 1, 2,3 and 3A are schematic perspective views showing different joystick embodiments of the invention.

Referring to FIG. 1, joystick 101 comprises a control shaft 103 with a control end 105 for manipulation by a user. The control shaft is pivoted around a pivot 107. A control plate 109 with an octagon shaped aperture 111 is disposed above the pivot 107, and defines the octagon shaped deflection limit pattern for the control shaft.

Figure 2:
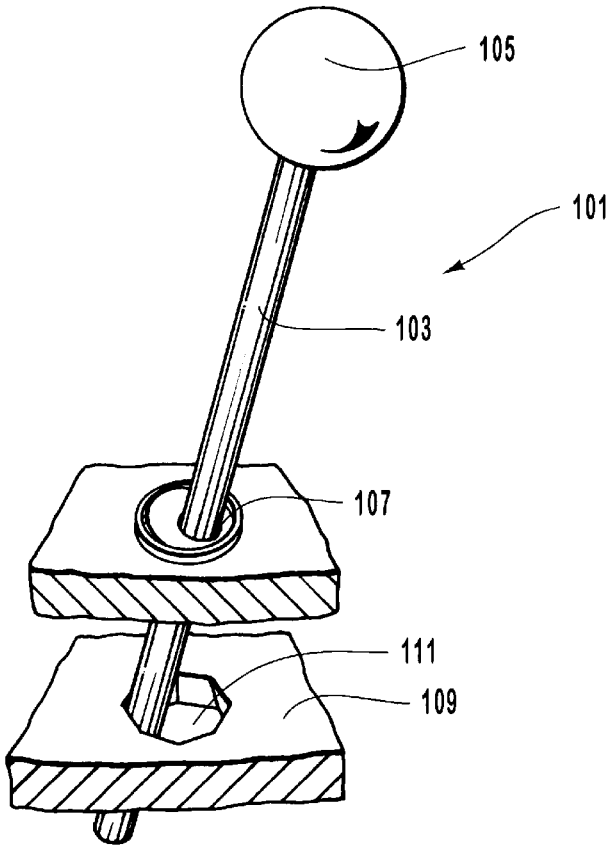

FIG. 2 is an alternate construction with the control plate 109 below the pivot 107.

Figure 3:
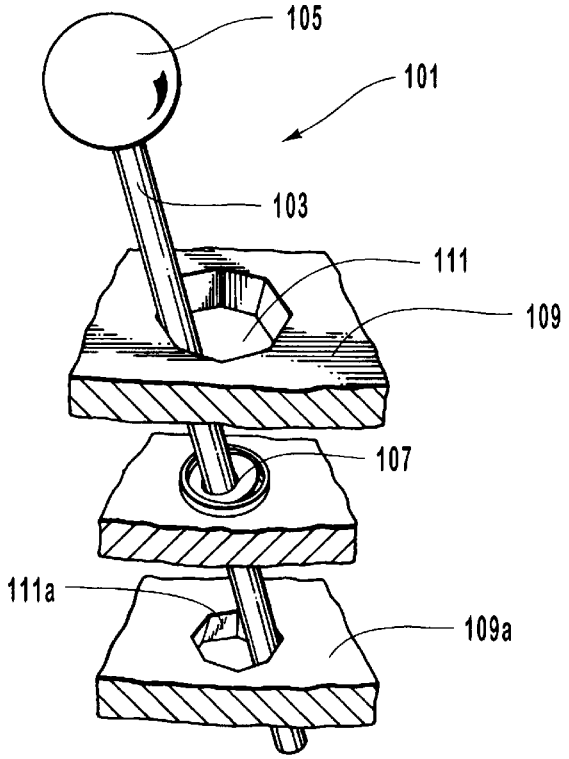

FIG. 3 is an alternate construction with two control plates 109, 109*a*, one below and one above the pivot 107, each with an octagon aperture 111.

Figure 3A:
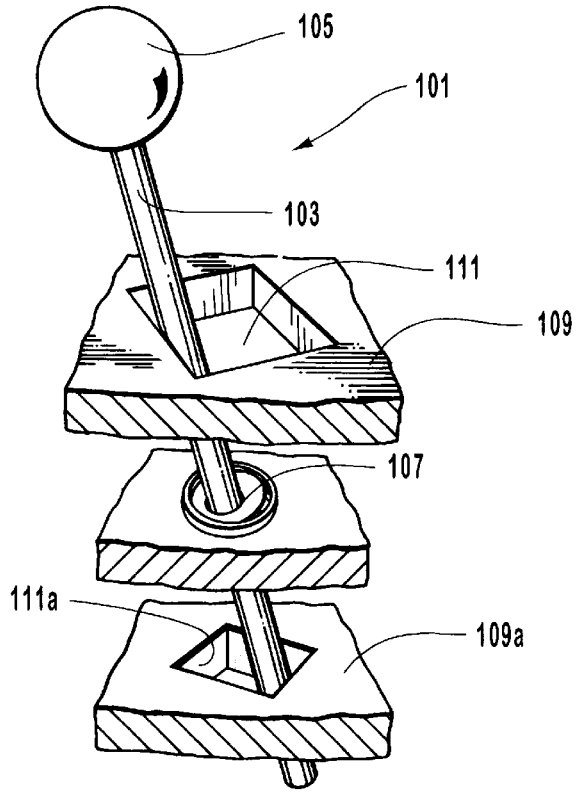

FIG. 3A shows an alternate construction with tow control plates 109, 109*a*, one below and one above the pivot 107, each with a square aperture 111, 111*a*, respectively. The apertures 111 and 111*a* are aligned 45° from one another.

Figure 4:
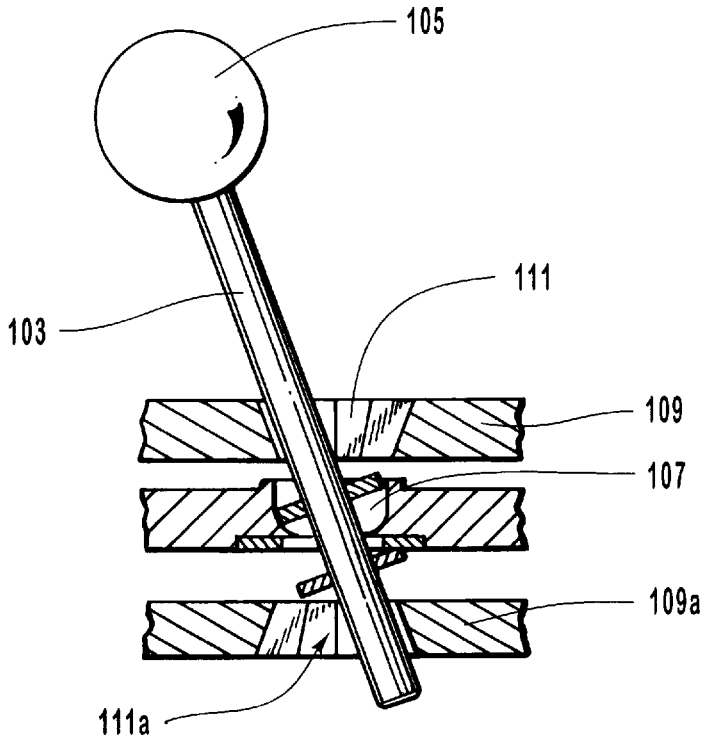
FIG. 4 is a cross-sectional schematic view of a joystick embodiment of the invention.

FIG. 4 is a cross-section of FIG. 3 showing the control shaft with control end, pivot, and control plates 109, 109*a*.

Figure 5:
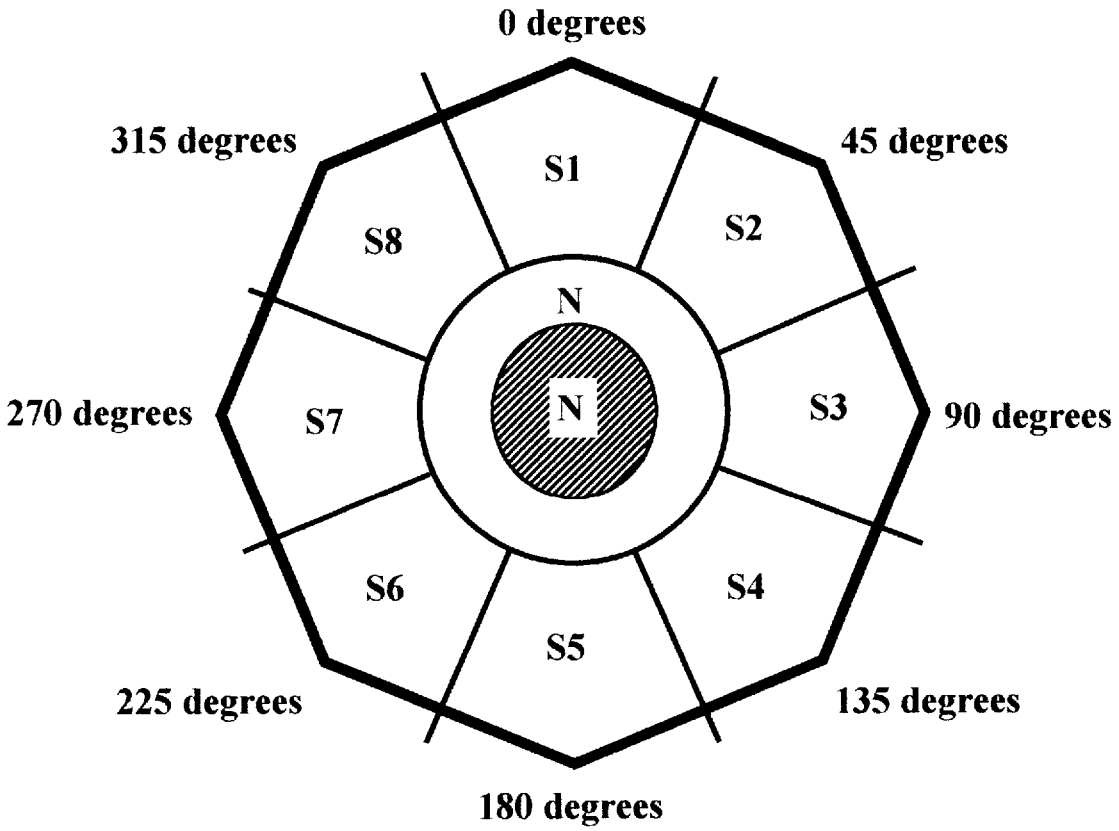
FIGS. 5 to 8 are sector diagrams illustrating the invention.

FIG. 5 is a sector diagram illustrating the octagon shaped deflection limit pattern. The corners of the octagon are generally at the centers of the control sectors S1, S2, . . . , S8, which are radially disposed around a neutral zone or sector, where there is no electrical or control indication produced by the indicator. In FIG. 5, the control shaft is shown in the neutral position in the middle of the neutral sector. The exact shape of the neutral sector may or may not be round as shown, depending upon the particular construction of the joystick, and construction of the indicator used to produce the electrical signal when the joystick passes into a control sector. For the same reasons, the boundaries between the control sectors may not necessarily extend in a perfect radial manner from the center as illustrated. However, at the limits of deflection, the comers of the octagon are preferably at or near the centers of the control sectors.

Figure 6:
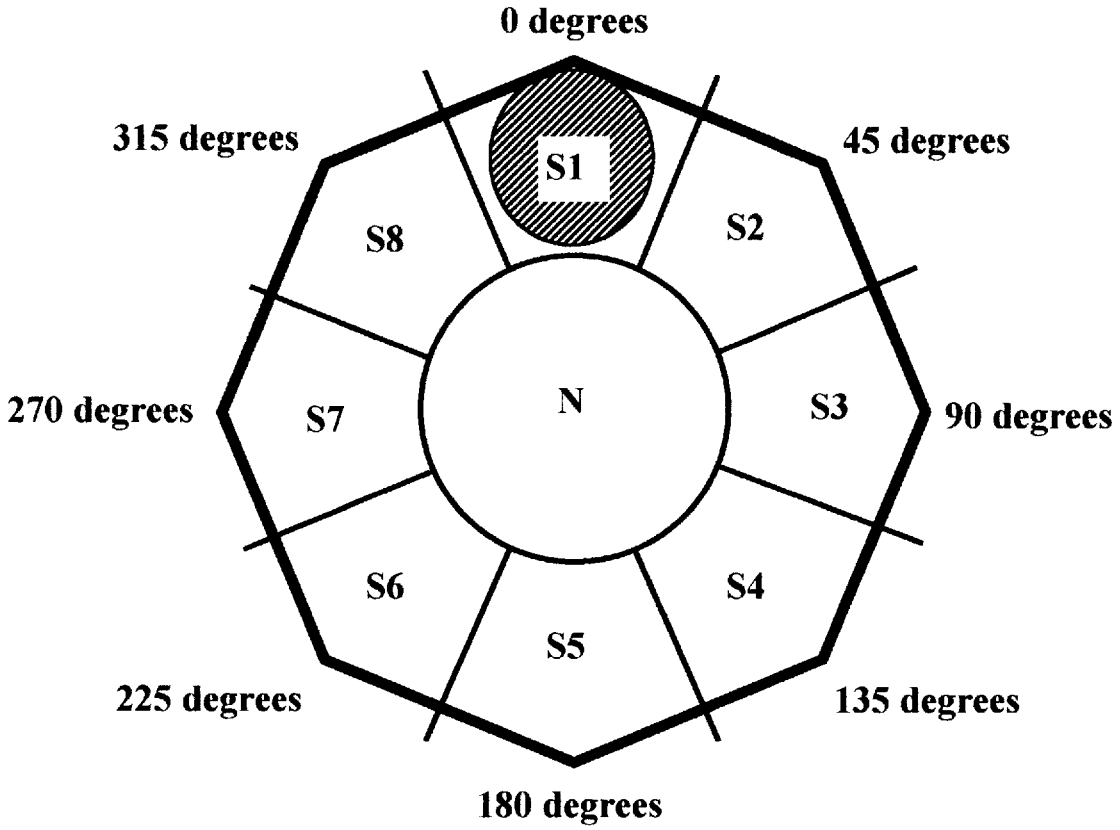

FIG. 6 shows a sector diagram with the control shaft in the comer corresponding to the 0 degree or up/forward position. The control shaft is firmly in the comer of the deflection limit octagon, thus indicating that the shaft is positioned firmly in the S1 control sector.

Figure 7:
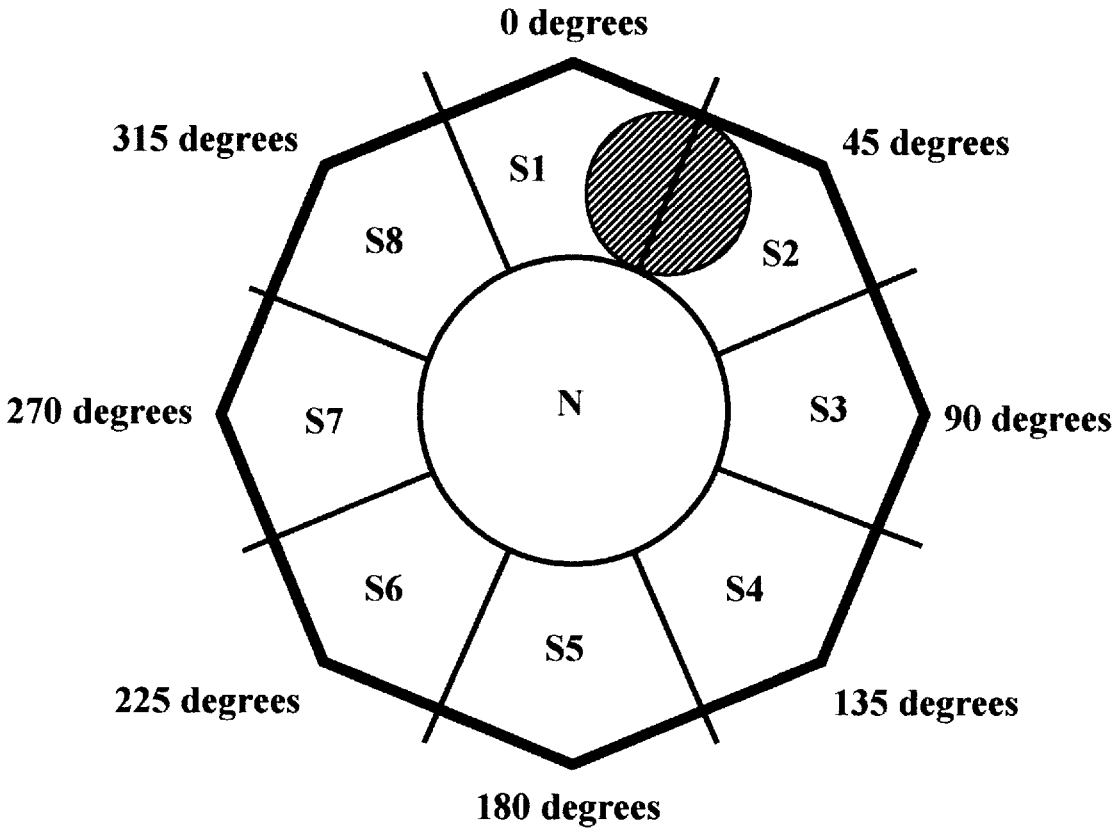

The sector diagram of FIG. 7 shows the control shaft at the deflection limit between sector S1 and S2. It is not in a comer, which provides indication to the user that the control shaft is not firmly in either sector, S1 or S2, and must be moved in either direction along the deflection limit to firmly put the control shaft in either one of those sectors.

Figure 8:
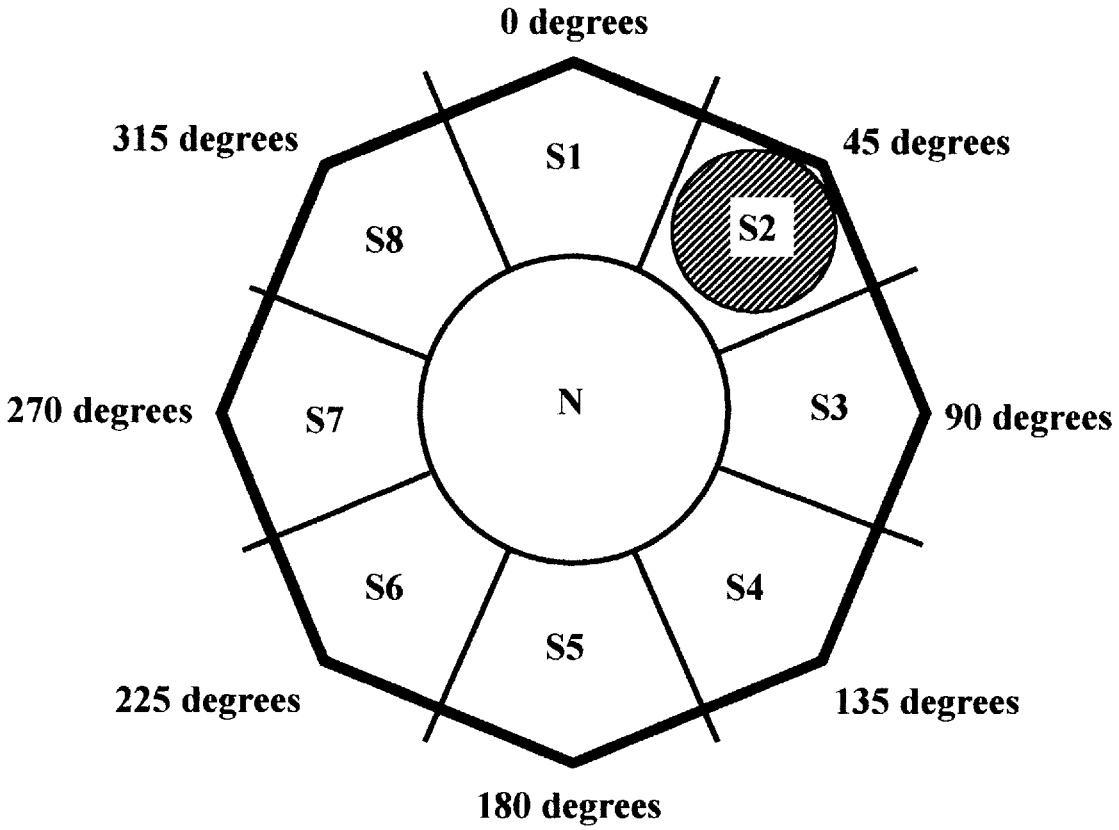

The sector diagram of FIG. 8 shows the control shaft firmly in the deflection limit comer corresponding to the center of control sector S2.

Figure 9:
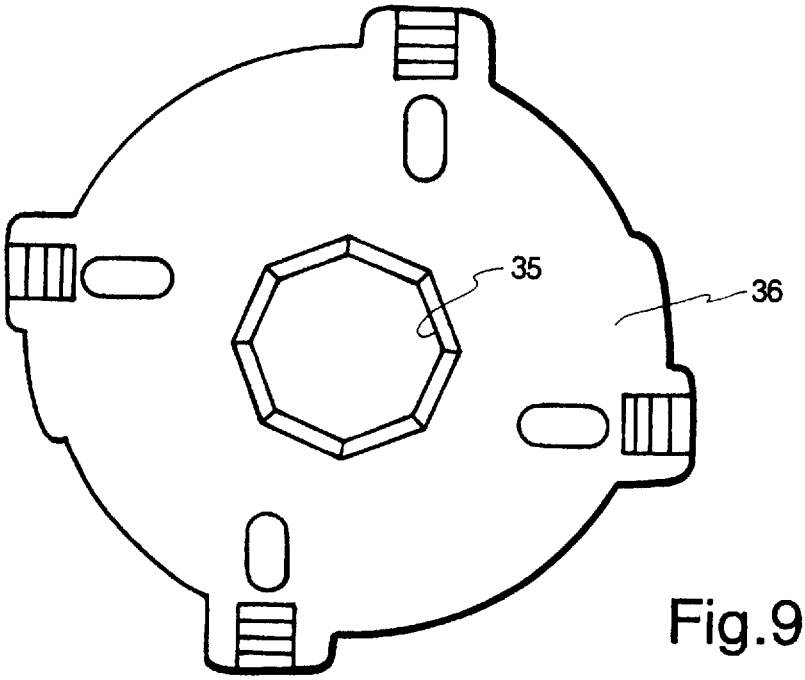
FIG. 9 is a top view of a top-view of a control plate the invention

FIG. 9 is a view of a control plate of the invention 36 with octagon shaped aperture 35. This control plate can be easily fabricated, molded, or stamped from metal, plastic, or any suitable manufacturing process and material.

Figure 10:
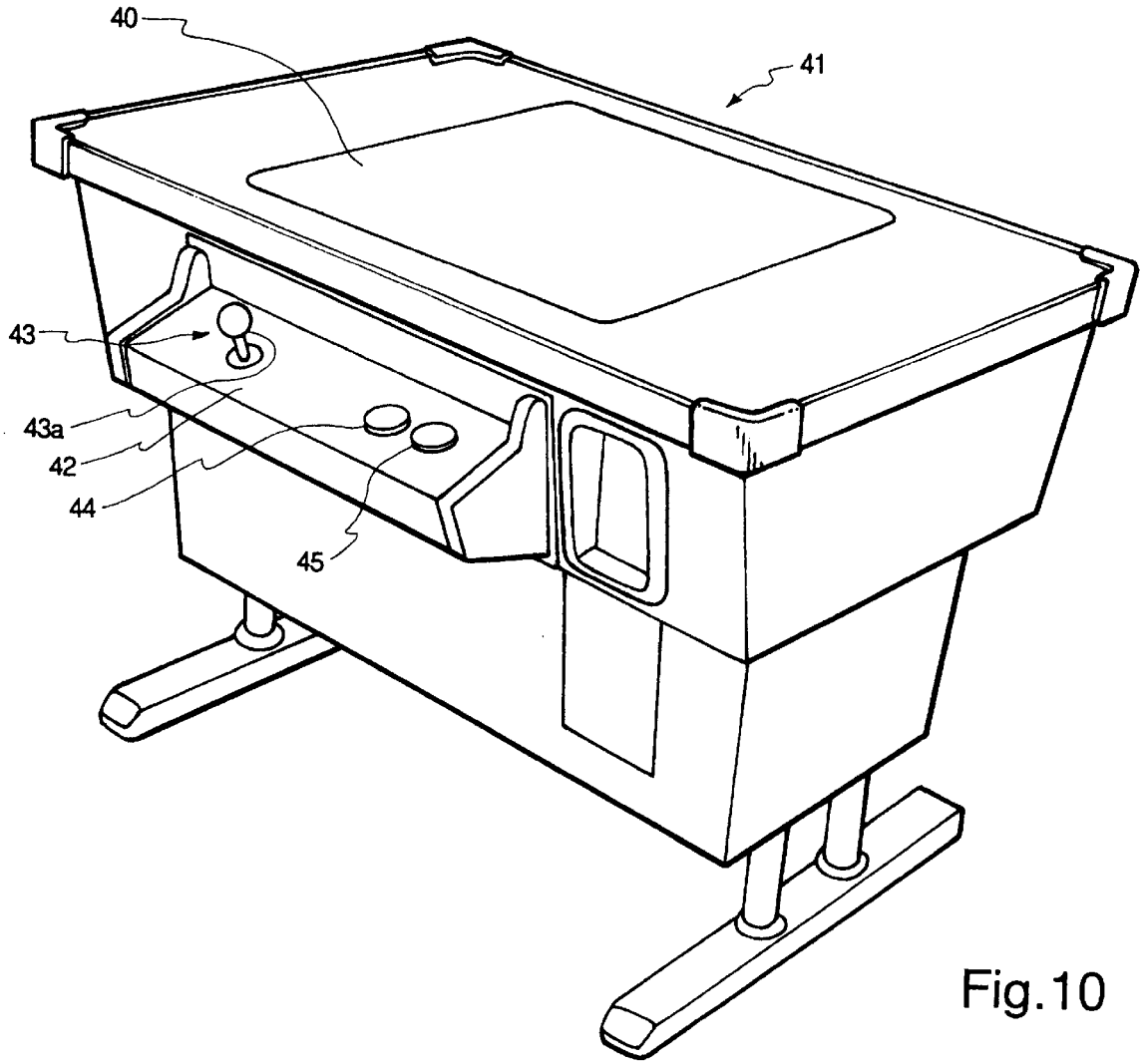
FIG. 10 is an arcade game incorporating joys-stick of the invention.
Figure 11:
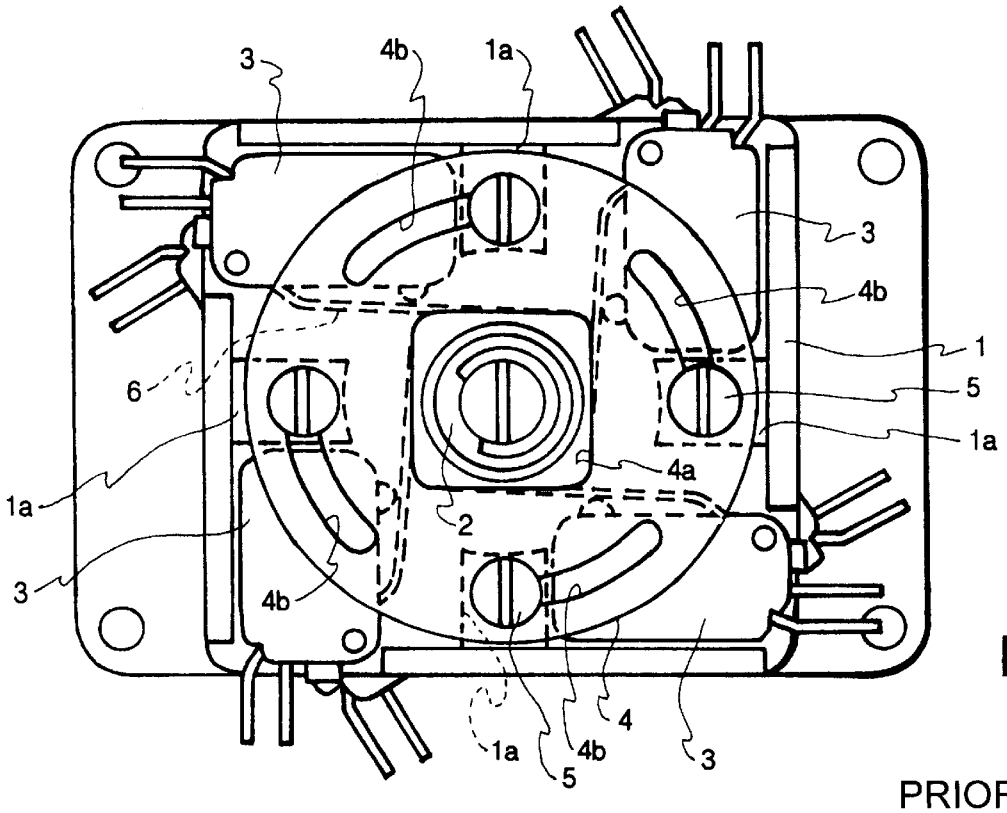
FIGS. 11 and 12 are bottom and side view, respectively, of a joystick of conventional construction that may be modified with a control plate of the invention.
Figure 12:
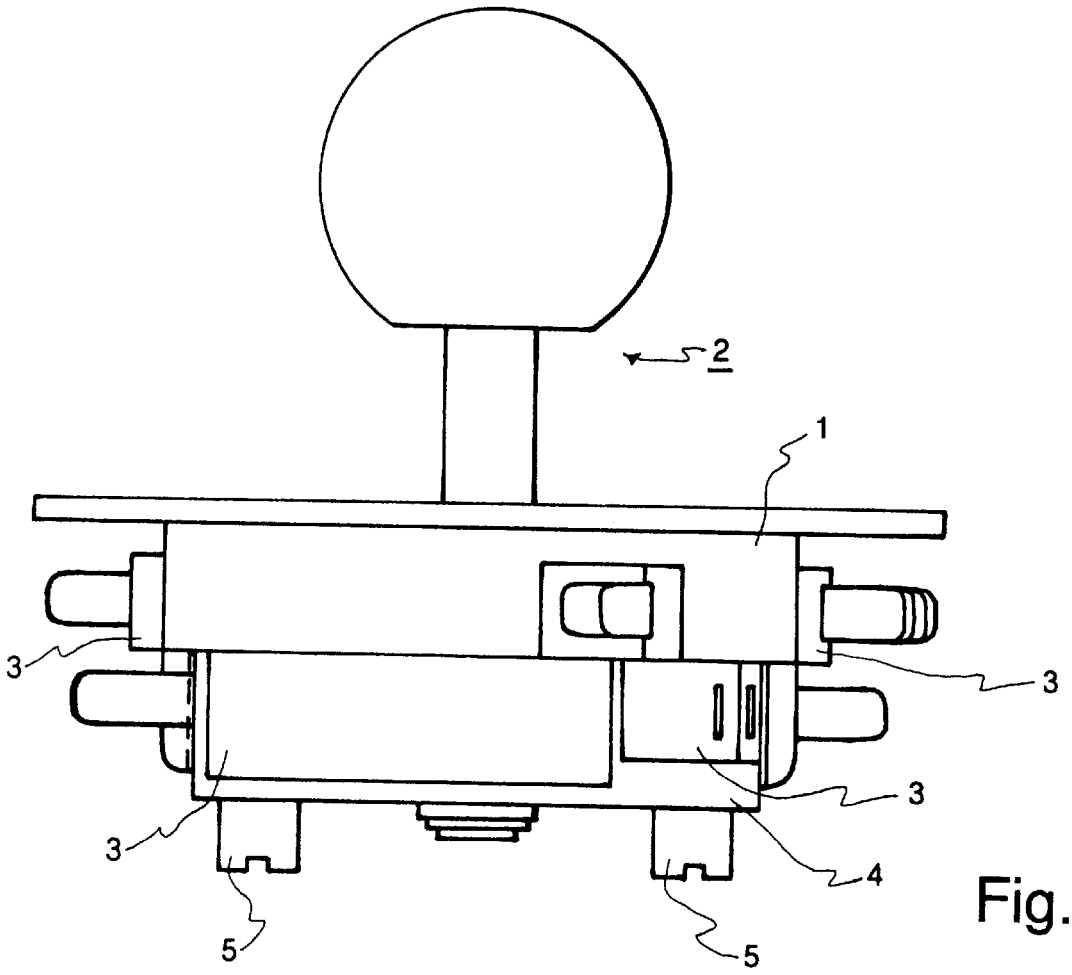

FIG. 10 is a perspective diagram showing how the joystick on the invention is applied to an arcade game 41, with joystick 43 with control shaft 43*a*, control buttons, 44, 45, and video screen 40, FIGS. 11 and 12 illustrate an joystick construction that can be applied to the present invention. The joystick a control shaft 2, an indicator in the form of microswitches 3 and leaf springs 6. A control plate 4 is mounted to the joystick at mounting busses 1*a* by means of screws 5 through mounting holes 4*b*.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. Joy-stick control system comprising an eight-way joystick and a control structure, the joystick being fully functional as an eight-way joy-stick without the control structure and comprising:

control shaft having a handle end adapted for grasping and deflection of the control shaft by a user, pivot defining a fixed point about which the control shaft is deflected at the handle end by the user, the control shaft having a central neutral position and eight control sector positions spaced radially around the neutral position, indicator that produces a distinctive electrical signal when the control shaft is in each of the control sector positions, the control structure releasably attached to the joystick, the control structure defining a deflection limit of the control shaft in an octagon shaped deflection pattern with eight corners, each of the corners corresponding to one of the eight control sector positions such that when the control shaft is deflected into any one of the eight corners the control shaft is positioned in the corresponding control sector position, the control structure providing a smooth structure for unimpeded movement of the control shaft along the deflection limit between the corners with each of the corners providing tactile feedback to the user indicating that the control shaft is in the control sector position corresponding to the corner.

2. The joystick control system of claim 1 wherein the control structure comprises a plate with an octagon shaped aperture which defines the deflection limit and through which the control shaft extends.

3. The joystick control system of claim 2 wherein the plate is disposed above the pivot point.

4. The joystick control system of claim 5 wherein the control structure additionally comprises a secondary plate disposed below the pivot point with an octagon shaped aperture though which the control shaft extends.

5. The joystick control system of claim 2 wherein the plate is disposed below the pivot point.

6. The joystick control system of claim 1 wherein the control structure comprises two plates, each having a square aperture through which the control shaft extends, the square aperture of one control plate aligned 45 degrees from the square aperture of the other control plate.

7. The joystick control system of claim 6 wherein one of the control plates is disposed above the pivot point and the other control plate is disposed below the pivot point.

8. The joystick control system of claim 1 wherein the indicator comprises electromechanical switches.

9. The joystick control system of claim 1 wherein the indicator comprises mechanical detectors.

10. The joystick control system of claim 1 wherein the indicator comprises electrical detectors.

11. The joystick control system of claim 1 wherein the indicator comprises opto-electrical detectors.

12. An eight-way joystick comprising:

control shaft having a handle end adapted for grasping and deflection of the control shaft by a user, pivot defining a fixed point about which the control shaft is deflected at the handle end by the user, the control shaft having a central neutral position and eight control sector positions spaced radially around the neutral position, indicator that produces a distinctive electrical signal when the control shaft is in each of the control sector positions, control structure which defines a deflection limit of the control shaft in an octagon shaped deflection pattern with eight corners, each of the corners corresponding to one of the eight control sector positions such that when the control shaft is deflected into any one of the eight corners the control shaft is positioned in the corresponding control sector position, the control structure providing a structure for smooth unimpeded movement of the control shaft along the deflection limit between the corners with each of the corners providing tactile feedback to the user indicating that the control shaft is in the control sector position corresponding to the corner, the control structure being removable such that the joystick is a fully functional eight-way joystick with or without the structure.

13. The joystick control system of claim 12 wherein the control structure comprises a plate with an octagon shaped aperture which defines the deflection limit and through which the control shaft extends.

14. The joystick control system of claim 13 wherein the plate is disposed above the pivot point.

15. The joystick control system of claim 13 wherein the plate is disposed below the pivot point.

16. The joystick control system of claim 15 wherein the control structure additionally comprises a secondary plate disposed below the pivot point with an octagon shaped aperture though which the control shaft extends.

17. The joystick control system of claim 12 wherein the control structure comprises two plates, each having a square aperture through which the control shaft extends, the square aperture of one control plate aligned 45 degrees from the square aperture of the other control plate.

18. The joystick control system of claim 17 wherein one of the control plates is disposed above the pivot point and the other control plate is disposed below the pivot point.

* * * * *